US011448237B2

(12) United States Patent
Miyata et al.

(10) Patent No.: US 11,448,237 B2
(45) Date of Patent: Sep. 20, 2022

(54) COMPRESSOR

(71) Applicant: MITSUBISHI HEAVY INDUSTRIES COMPRESSOR CORPORATION, Tokyo (JP)

(72) Inventors: Hiroyuki Miyata, Hiroshima (JP); Masahiro Kobayashi, Hiroshima (JP); Akihiro Nakaniwa, Tokyo (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 16/780,100

(22) Filed: Feb. 3, 2020

(65) Prior Publication Data

US 2020/0271130 A1 Aug. 27, 2020

(30) Foreign Application Priority Data

Feb. 25, 2019 (JP) ..... JP2019-031604

(51) Int. Cl.

| | |
|---|---|
| ***F04D 29/58*** | (2006.01) |
| ***F04D 29/44*** | (2006.01) |
| ***F04D 25/06*** | (2006.01) |
| ***F04D 27/02*** | (2006.01) |
| ***F04D 15/00*** | (2006.01) |

(Continued)

(52) U.S. Cl.

CPC ..... *F04D 29/5826* (2013.01); *F04D 25/0606* (2013.01); *F04D 27/0238* (2013.01); *F04D 29/441* (2013.01); *F04D 29/5806* (2013.01); *F04D 29/5833* (2013.01);

(Continued)

(58) Field of Classification Search

CPC ..... F04D 29/5826; F04D 27/0238; F04D 25/0606; F04D 29/441; F04D 29/5833; F04D 29/5806; F04D 29/5866; F04D 15/0005; F04D 27/006; F04D 13/06

See application file for complete search history.

(56) References Cited

U.S. PATENT DOCUMENTS 2,793,506 A * 5/1957 Moody ..... F04D 25/06 62/505

6,102,672 A 8/2000 Woollenweber et al.

(Continued)

FOREIGN PATENT DOCUMENTS

BE 892568 A 9/1982

CN 106194801 A 12/2016

(Continued)

*Primary Examiner* — Kenneth J Hansen

(74) *Attorney, Agent, or Firm* — Osha Bergman Watanabe & Burton LLP

(57) ABSTRACT

A compressor 1 includes a casing 2 that covers a rotating shaft 4 and an impeller 6 and is provided with a diffuser 66 for guiding the working fluid discharged from the impeller 6 to an outside in a radial direction, a heat exchanger 71 that is cools at least a portion of the working fluid compressed by the impeller 6, a cooling fluid supplying unit 7 that supplies the working fluid cooled by the heat exchanger 71 into the casing 2 as a cooling fluid for cooling a motor 5 disposed in the casing 2, and a cooling fluid circulating unit 8 that discharges the cooling fluid that has passed through the motor 5 to an outside of the casing 2, and supplies the discharged cooling fluid downstream of an outlet 6*o* of a first impeller 6A and upstream of the diffuser 66.

4 Claims, 5 Drawing Sheets

(51) Int. Cl.
*F04D 27/00* (2006.01)
*F04D 13/06* (2006.01)

(52) U.S. Cl.
CPC ..... *F04D 13/06* (2013.01); *F04D 15/0005* (2013.01); *F04D 27/006* (2013.01); *F04D 29/5866* (2013.01)

(56) References Cited

U.S. PATENT DOCUMENTS

| | | | | |
|---|---|---|---|---|
| 6,324,858 | B1 | 12/2001 | Holden | |
| 2007/0212232 | A1* | 9/2007 | De Larminat | F04D 25/06 417/83 |
| 2015/0064026 | A1* | 3/2015 | Maier | F04D 25/0606 417/53 |
| 2015/0086394 | A1* | 3/2015 | Taguchi | F04D 25/06 417/366 |
| 2019/0055954 | A1* | 2/2019 | Egawa | F04D 29/5806 |

FOREIGN PATENT DOCUMENTS

| | | | |
|---|---|---|---|
| CN | 107664143 | A | 2/2018 |
| JP | S57-166450 | A | 10/1982 |
| JP | H06280771 | A | 10/1994 |
| JP | 2001-515991 | A | 9/2001 |
| JP | 2002-064956 | A | 2/2002 |
| JP | 2009-180151 | A | 8/2009 |
| KR | 10-2015-0005044 | A | 1/2015 |

* cited by examiner

COMPRESSOR

BACKGROUND OF THE INVENTION

Field of the Invention

The present invention relates to a compressor.

Priority is claimed on Japanese Patent Application No. 2019-031604, filed on Feb. 25, 2019, the contents of which are incorporated herein by reference.

Description of Related Art

Generally, a centrifugal compressor includes an impeller provided on a rotating shaft, and a casing that covers the impeller to define a flow passage through which a fluid flows together with the impeller. In the centrifugal compressor, the fluid supplied from the outside through the flow passage formed in the casing is compressed by the rotation of the impeller.

In such a centrifugal compressor, when a motor for driving the impeller to rotate is built in the casing, the operating efficiency of the motor may be reduced when the temperature of the motor becomes excessively high. Further, when a bearing that rotatably supports a rotating shaft is provided in the casing, it is necessary to suppress the increase in friction loss due to an excessive temperature rise of the bearing. Therefore, it is preferable to cool the motor and the bearing.

For example, Japanese Unexamined Patent Application, First Publication No. 2002-64956 discloses a structure in which air compressed by an impeller is cooled by a cooler and then supplied to a motor in a housing. In Japanese Unexamined Patent Application, First Publication No. 2002-64956, After cooling the motor, the air is returned from a labyrinth seal provided between the rotor shaft and a through-hole of the housing to the inside of the compressor through the back surface of the impeller.

SUMMARY OF THE INVENTION

However, in the structure as disclosed in Patent Document 1, since the air that has cooled the motor passes through the labyrinth seal, the pressure loss is significant. Furthermore, the pressure of air that has passed through the labyrinth seal has dropped. For this reason, in order to pass through the back surface of the impeller and join the air pressurized by the impeller, the pressure of the cooled air may be needed to be increased. When the pressure-increase is performed again only for the purpose of returning the air after cooling, power loss occurs. Thus, in the structure disclosed in Patent Document 1, there is a significant loss in the process of flowing the air that has cooled the cooling object part such as a motor.

The present invention provides a compressor capable of suppressing loss and increasing the efficiency while cooling a cooling object part in the compressor.

A compressor according to a first aspect of the present invention includes a rotating shaft that is configured to rotate around an axis, an impeller that is configured to rotate along with the rotating shaft to compress and discharge an intake working fluid, a casing that is configured to cover the rotating shaft and the impeller and is provided with a diffuser for guiding the discharged working fluid from the impeller to an outside in a radial direction of the rotating shaft, a heat exchanger that is configured to cool at least a portion of the working fluid compressed by the impeller, a cooling fluid supplying unit that is configured to supply the working fluid cooled by the heat exchanger into the casing as a cooling fluid for cooling a cooling object part disposed in the casing, and a cooling fluid circulating unit that is configured to discharge the cooling fluid that has passed through the cooling object part to an outside of the casing, and supply the discharged cooling fluid downstream of an outlet of the impeller and upstream of the diffuser.

With such a configuration, the cooling object part in the casing can be cooled with the cooling fluid supplied into the casing by a cooling fluid supplying unit. The cooling fluid passing through the cooling object part is supplied downstream of the outlet of the impeller and upstream of the diffuser. Therefore, it is not necessary to pressurize the cooling fluid again with the impeller, and it is possible to suppress the occurrence of loss. Further, the cooling fluid is returned upstream of the diffuser provided outside of the impeller in the radial direction. The pressure at an inlet of the diffuser is lower than that at the outlet of the diffuser. Accordingly, it is easier to flow the cooling fluid in than a case of returning it to the position after passing through the diffuser. Therefore, by returning the cooling fluid used for cooling upstream of the diffuser, it is possible to efficiently circulate the cooling fluid. As a result, it is possible to suppress loss and improve the efficiency of a compressor while cooling the cooling object part in the compressor.

In the compressor according to a second aspect of the present invention, in the first aspect, the casing may have nozzles that are connected with the diffuser and are disposed at intervals in a circumferential direction around the axis of the rotating shaft, and the cooling fluid circulating unit may supply the cooling fluid discharged to the outside of the casing to the diffuser through the nozzles.

With such a configuration, the cooling fluid is supplied to the diffuser through the nozzles. As a result, it is possible to make the pressure distribution of the working fluid in the circumferential direction in the diffuser uniform.

In the compressor according to a third aspect of the present invention, in the second aspect, each of the nozzles may be inclined with respect to an axial direction in which the axis extends, and extend in a direction along a flow of the working fluid discharged from the impeller.

With such a configuration, it is possible to suppress interference between the working fluid sent out from the nozzle and the flow of the working fluid discharged from the impeller, and thus to suppress loss.

In the compressor according to a fourth aspect of the present invention, in the second aspect or the third aspect, the compressor may further include a chamber that extends in the circumferential direction and is connected to the nozzles, and the cooling fluid circulating unit may supply the cooling fluid discharged to the outside of the casing to the nozzles through the chamber.

With such a configuration, when the cooling fluid flows into the circumferentially continuous chamber, the pressure distribution of the cooling fluid is made uniform in the chamber. Then, by feeding the cooling fluid from the chamber to each nozzle, it is possible to make the pressure distribution of the working fluid in the circumferential direction in the diffuser more uniform.

In the compressor according to a fifth aspect of the present invention, in any one of the first aspect to the fourth aspect, the compressor may further include a motor that is disposed in the casing and is configured to drive the rotating shaft to rotate around the axis, and the cooling fluid supplied into the casing by the cooling fluid supplying unit may cool the motor as the cooling object part.

With such a configuration, it is possible to cool the motor with the cooling fluid and thus to suppress the temperature rise of the motor. When the temperature of the motor rises, demagnetization of the magnet (permanent magnet) included in the motor occurs. By suppressing the temperature rise of the motor, it is possible to suppress demagnetization and thus to suppress the decrease in output of the motor.

In the compressor according to a sixth aspect of the present invention, in the fifth aspect, the compressor may further include a detecting unit that is configured to detect a parameter that varies in correlation with a temperature change of the motor, and a flow rate adjusting unit that is configured to adjust a flow rate of the cooling fluid supplied into the casing based on a determination result in the detecting unit.

With such a configuration, it is possible to adjust the flow rate of the cooling fluid based on a parameter that varies in correlation with the temperature change of the motor, and thus to adjust the degree of cooling of the cooling object part by the cooling fluid.

According to the present invention, it is possible to suppress loss and improve the efficiency of a compressor while cooling a cooling object part in the compressor.

DETAILED DESCRIPTION OF THE INVENTION

Hereinafter, embodiments for carrying out a compressor according to the present invention will be described with reference to the accompanying drawings. However, the present invention is not limited only to the embodiments.

First Embodiment

Figure 1:
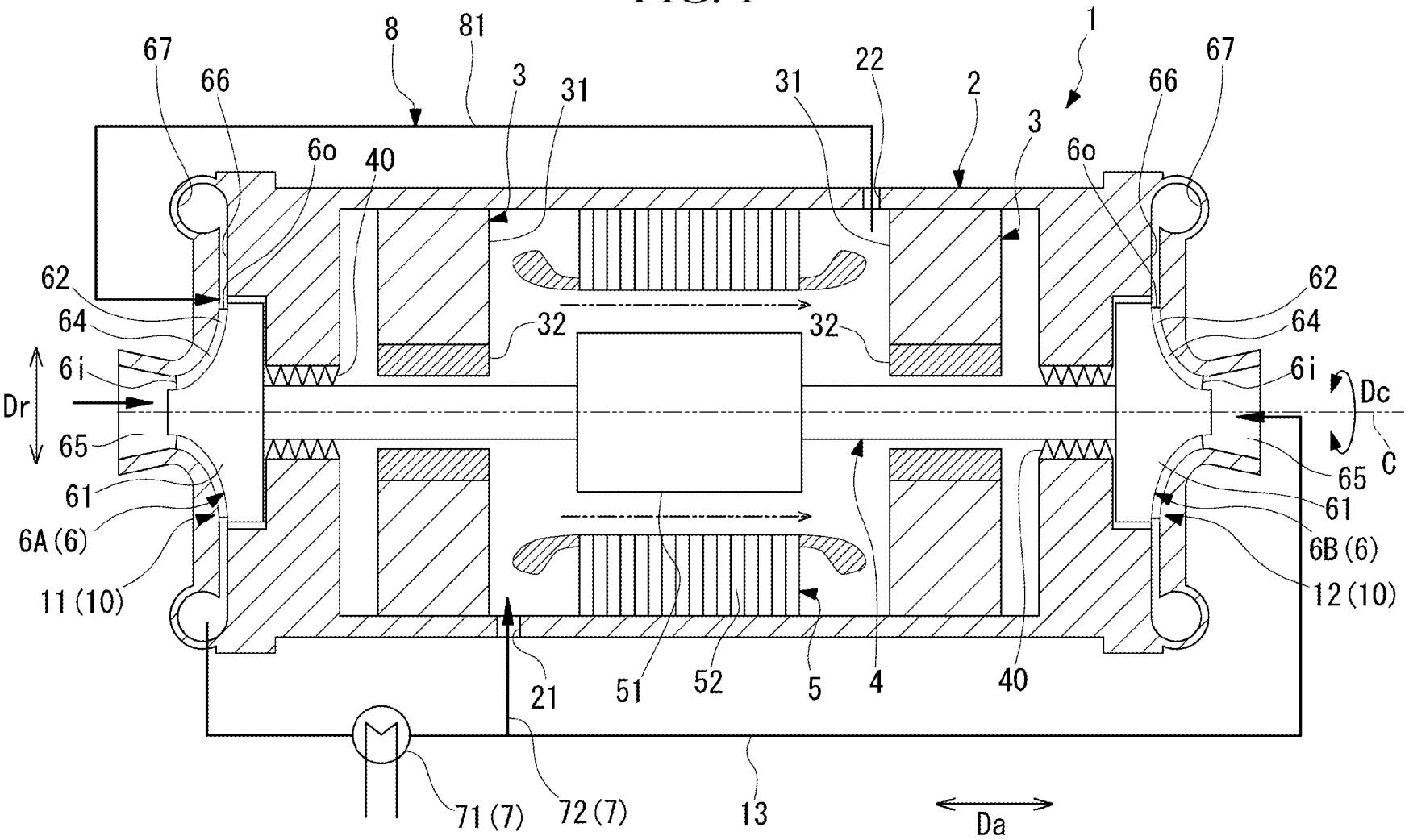
FIG. 1 is a schematic diagram showing a schematic configuration of a compressor according to a first embodiment of the present invention.

FIG. 1 is a schematic diagram showing a schematic configuration of a compressor according to a first embodiment of the present invention. As shown in FIG. 1, the compressor 1 of the present embodiment is a motor-integrated compressor including a plurality of impellers 6. The compressor 1 includes a casing 2, a bearing 3, a rotating shaft 4, a motor 5, an impeller 6, a cooling fluid supplying unit 7, and a cooling fluid circulating unit 8. The compressor 1 of the present embodiment constitutes a system such as a plant together with various devices upstream (front stage) and downstream (rear stage) of the compressor 1 itself. The compressor 1 of the present embodiment includes a pair of compression sections 10. The pair of compression sections 10 includes a first-stage first compression section 11 and a second-stage second compression section 12. That is, the compressor 1 may be a single-shaft two-stage compressor.

In the compressor 1, the working fluid (process gas) compressed by the first-stage first compression section 11 flows into the second-stage second compression section 12 through a pressurization gas line 13. The pressurization gas line 13 connects the outlet of the first compression section 11 and the inlet of the second compression section 12. In the process of flowing through the second compression section 12, the working fluid is further compressed to be a high-pressure working fluid.

The casing 2 forms the outer shell of the compressor 1. The casing 2 covers the bearing 3, the rotating shaft 4, the motor 5, and the impellers 6.

A pair of bearings 3 is provided in the casing 2 with a gap in the axial direction Da of the axis C of the rotating shaft 4 extending in the horizontal direction. The bearings 3 are held by the casing 2. The bearing 3 of the present embodiment is a gas bearing to which gas is supplied. The bearing 3 is supplied with bleed air from the working fluid pressurized by the first compression section 11 in order to apply dynamic pressure. The bearing 3 is supplied with external gas or bleed gas in order to apply static pressure. The bearing 3 includes a plurality of strip-shaped pads 32 and a bearing housing 31 that holds the pads 32. The pad 32 is curved along the outer surface of the rotating shaft 4. The bearing housing 31 is integrally provided in the casing 2 so as to protrude from the inner peripheral surface of the casing 2 toward the outer surface of the rotating shaft 4.

The rotating shaft 4 is rotatable around the axis C. The rotating shaft 4 is supported by a pair of bearings 3 so as to be rotatable around the axis C. The rotating shaft 4 is sealed by a sealing portion 40, which is provided up to the casing 2, and outside the bearing 3 and inside the impeller 6 with respect to the axial direction Da. Both end portions of the rotating shaft 4 protrude from corresponding ones of the pair of bearings 3 in the axial direction Da.

The motor 5 is disposed between the first compression section 11 and the second compression section 12. The motor 5 of the present embodiment is disposed between the pair of bearings 3 in the axial direction Da. The motor 5 includes a motor rotor 51 fixed to be integrated with the rotating shaft 4, and a stator 52 covering the motor rotor 51. The motor rotor 51 includes a plurality of permanent magnets (not shown) arranged at intervals in the circumferential direction Dc around the axis C. The stator 52 is fixed to the casing 2. When electric power is applied to the coil provided in the stator 52, the motor rotor 51 rotates with respect to the stator 52. Thereby, the motor 5 outputs a rotational driving force to the rotating shaft 4 and rotates the entire rotating shaft 4 together with the first compression section 11 and the second compression section 12.

The impeller 6 rotates integrally with the rotating shaft 4. The impeller 6 is fixed to the rotating shaft 4 at a position separated from the bearing 3 in the axial direction Da. The impeller 6 of the present embodiment is fixed to the rotating shaft 4 outside the pair of bearings 3 with respect to the axial direction Da. Specifically, the impeller 6 is provided at both ends of the rotating shaft 4. In the compressor 1 of the present embodiment, the impeller 6 includes two impellers, that is, a first impeller 6A provided in the first compression section 11 and a second impeller 6B provided in the second compression section 12. The second impeller 6B is disposed to face in the direction opposite to the first impeller 6A with respect to the axial direction Da. The second impeller 6B compresses the working fluid compressed by the first impeller 6A. Each of the impellers 6 is a so-called open impeller including a disk portion 61 and a blade portion 62 in the present embodiment.

The disk portion 61 has a disk shape. For example, the outer diameter of the disk portion 61 of the first impeller 6A is gradually reduced from one side in the axial direction Da toward the other side in the axial direction Da. That is, the disk portion 61 has a substantially umbrella shape as a whole. On the one side of the first impeller 6A of the present embodiment in the axial direction Da, the first compression section 11 is disposed for the motor 5 in FIG. 1. On the other side of the first impeller 6A in the axial direction Da, the second compression section 12 is disposed for the motor 5. Conversely, on one side of the second impeller 6B in the axial direction Da, the second compression section 12 is disposed for the motor 5. On the other side of the second impeller 6B in the axial direction Da, the first compression section 11 is disposed for the motor 5.

The blade portion 62 is provided on one side of the disk portion 61 in the axial direction Da. A plurality of blade portions 62 are provided at intervals in the circumferential direction.

In each of the impellers 6, an impeller channel 64 is formed by the disk portion 61 and the blade portion 62. The impeller channel 64 has an inlet 6*i* through which the working fluid flows in and an outlet 6*o* through which the working fluid is discharged. An inlet 6*i* is located on one side of the impeller 6 in the axial direction Da and inward of the impeller 6 in the radial direction Dr. The inlet 6*i* is open toward one side in the axial direction Da. An outlet 6*o* is located on the other side of the impeller 6 in the axial direction Da and outward of the impeller 6 in the radial direction Dr. The outlet 6*o* opens toward the outside in the radial direction Dr.

In the casing 2, an intake passage 65, a diffuser 66, and an exhaust passage 67 are formed around each of the impellers 6. The intake passage 65 communicates the inlet 6*i* of the impeller 6 with the outside of the casing 2. The diffuser 66 extends from the outlet 6*o* of the impeller 6 toward the outside in the radial direction Dr. The diffuser 66 is formed as a linear flow passage so as to be orthogonal to the axis C. The diffuser 66 guides the working fluid discharged from the impeller 6 to the outside in the radial direction Dr and sends it to the exhaust passage 67. For example, a diffuser vane (not shown) is provided in the diffuser 66. When the working fluid compressed by the impeller 6 passes through the diffuser 66, the flow speed is reduced and the pressure is further increased. The exhaust passage 67 is connected to the outer side of the diffuser 66 in the radial direction Dr. The exhaust passage 67 extends in a spiral around the axis C. The working fluid sent to the spiral exhaust passage 67 is discharged to the outside of the casing 2. The working fluid discharged from the exhaust passage 67 corresponding to the first compression section 11 is sent to the second compression section 12 through the pressurization gas line 13. The working fluid discharged from the exhaust passage 67 corresponding to the second compression section 12 is sent to other devices other than the compressor 1 through pipe (not shown).

The cooling fluid supplying unit 7 supplies the cooled working fluid into the casing 2 as a cooling fluid for cooling the cooling object part disposed in the casing 2. The cooling fluid supplying unit 7 includes a heat exchanger 71 and a supply pipe 72. The heat exchanger 71 cools the working fluid compressed by the first impeller 6A and uses the cooled working fluid as a cooling fluid. Hereinafter, the working fluid cooled by the heat exchanger 71 is referred to as a cooling fluid. In the present embodiment, the heat exchanger 71 is provided in the pressurization gas line 13. The heat exchanger 71 cools all the working fluid discharged from the outlet (exhaust passage 67) of the first compression section 11 and flowing into the pressurization gas line 13. The supply pipe 72 supplies some of the working fluid after being cooled by the heat exchanger 71 to the inside of the casing 2. In the present embodiment, the supply pipe 72 is branched from the pressurization gas line 13, downstream of the heat exchanger 71 in the flow direction of the working fluid in the pressurization gas line 13. The supply pipe 72 is connected to an inlet-side connection opening 21 formed in the casing 2. In the casing 2, the inlet-side connection opening 21 is formed on the first side of the motor rotor 51 and the stator 52 in the axis C direction (close to the first compression section 11). The inlet-side connection opening 21 is connected to a space in the casing 2 where the motor rotor 51 and the stator 52 are disposed. Some of the cooling fluid cooled by the heat exchanger 71 flows into the supply pipe 72, and the remainder of the cooling fluid is sent to the second compression section 12 through the pressurization gas line 13.

The cooling fluid supplied from the supply pipe 72 to the inside of the casing 2 through the inlet-side connection opening 21 cools the motor 5 in the casing 2. That is, in the present embodiment, the cooling fluid supplied into the casing 2 by the cooling fluid supplying unit 7 cools the motor 5 as a cooling object part. In the casing 2, the cooling fluid passes through the gap between the motor rotor 51 and the stator 52 constituting the motor 5 in the axial direction Da. In the motor 5, the coil generates heat when electric power is applied to the coil of the stator 52. The coil of the stator 52 is cooled by the cooling fluid, and the temperature rise is suppressed.

The cooling fluid circulating unit 8 discharges the cooling fluid that has passed through the motor 5 to the outside of the casing 2 once. The cooling fluid circulating unit 8 supplies the discharged cooling fluid downstream of the outlet 6*o* of the impeller 6 and upstream of the diffuser 66 (inlet of the diffuser 66). The cooling fluid circulating unit 8 has a discharge pipe 81. The discharge pipe 81 discharges the cooling fluid that has cooled the motor 5 from the casing 2 to the outside. The discharge pipe 81 returns the cooling fluid discharged to the outside of the casing 2 to the inlet of the diffuser 66 in the casing 2. One end of the discharge pipe 81 is connected to the outlet-side connection opening 22 formed in the casing 2. In the casing 2, the outlet-side connection opening 22 is formed on the second side, which is opposite to the inlet-side connection opening 21, in the axis direction C (on the side of the second compression section 12) with the motor rotor 51 and the stator 52 interposed therebetween. The outlet-side connection opening 22 is connected to a space in the casing 2 where the motor rotor 51 and the stator 52 are disposed. The other end of the discharge pipe 81 is connected between the outlet 6*o* of the impeller 6 in the first compression section 11 and the diffuser 66. The cooling fluid that has cooled the motor 5 in the casing 2 flows into the discharge pipe 81 from the outlet-side connection opening 22 and is supplied to the inlet of the diffuser 66.

In the compressor 1, the working fluid to be compressed is supplied to the intake passage 65 in the first compression section 11 and compressed by the first impeller 6A. The working fluid compressed by the first impeller 6A passes through the diffuser 66 and the exhaust passage 67 in the first compression section 11 and is sent to the pressurization gas line 13. The working fluid flowing into the pressurization gas line 13 is cooled by the heat exchanger 71 and introduced into the second compression section 12. The working fluid introduced into the second compression section 12 is further compressed by the second impeller 6B. The working fluid compressed by the second compression section 12 is supplied to a predetermined plant as a supply destination.

Further, some of the working fluid cooled by the heat exchanger 71 is supplied into the casing 2 from the inlet-side connection opening 21 through the supply pipe 72 without being sent to the second compression section 12. The motor 5 is cooled by the cooling fluid flowing in the casing 2. The cooling fluid that has cooled the motor 5 flows into the discharge pipe 81 from the outlet-side connection opening 22. The cooling fluid discharged to the outside of the casing 2 by flowing into the discharge pipe 81 is supplied to the inlet of the diffuser 66. Then, the cooling fluid is sent to the pressurization gas line 13 through the diffuser 66 and the exhaust passage 67 together with the working fluid compressed in the first impeller 6A.

With the compressor 1 as described above, the cooling fluid is supplied by the cooling fluid supplying unit 7, thereby making it is possible to cool the motor 5 in the casing 2. The cooling fluid that passing through the motor 5 is returned downstream of the outlet 6*o* of the first impeller 6A in the first compression section 11 and upstream of the diffuser 66. Therefore, it is not necessary to pressurize the cooling fluid again with the first impeller 6A, and it is possible to suppress the occurrence of loss. Further, the cooling fluid is returned to the inlet of the diffuser 66 without passing through the sealing portion 40 provided on the side of the first impeller 6A. Therefore, it is also possible to suppress the pressure loss caused by passing through the sealing portion 40.

Further, the cooling fluid is returned to the inlet of the diffuser 66 provided outside the first impeller 6A in the radial direction Dr. At the inlet of the diffuser 66, the pressure is lower than that of the pressurization gas line 13 through which the working passing through the diffuser 66 and the exhaust passage 67 flows. Therefore, the cooling fluid more easily flow in at the inlet of the diffuser 66 having a lower pressure as compared to the case where it is returned to the position after passing through the diffuser, such as the exhaust passage 67 or the pressurization gas line 13. Therefore, by returning the cooling fluid used for cooling the motor 5 to the inlet of the diffuser 66, it is possible to efficiently circulate the cooling fluid. As a result, it is possible to suppress the loss while cooling the motor 5 in the compressor 1 and increase the efficiency of the compressor.

Moreover, the motor 5 is cooled by the cooling fluid obtained by cooling the working fluid compressed by the first impeller 6A with the heat exchanger 71, thereby making it possible to suppress the temperature rise of the motor 5. When the temperature of the motor 5 rises, demagnetization of the magnet (permanent magnet) included in the motor 5 occurs. By suppressing the temperature rise of the motor 5 through the cooling by the cooling fluid, it is possible to suppress demagnetization and thus to suppress decrease in output of the motor 5.

Second Embodiment

Next, a second embodiment of the compressor of the present invention will be described with reference to FIG. 2 and FIG. 3. The compressor 1B shown in the second embodiment is different from the first embodiment in that it includes a flow rate adjusting unit 9. Therefore, in the description of the second embodiment, the same portions as those in the first embodiment are denoted by the same reference numerals and repeated descriptions thereof will be omitted.

Figure 2:
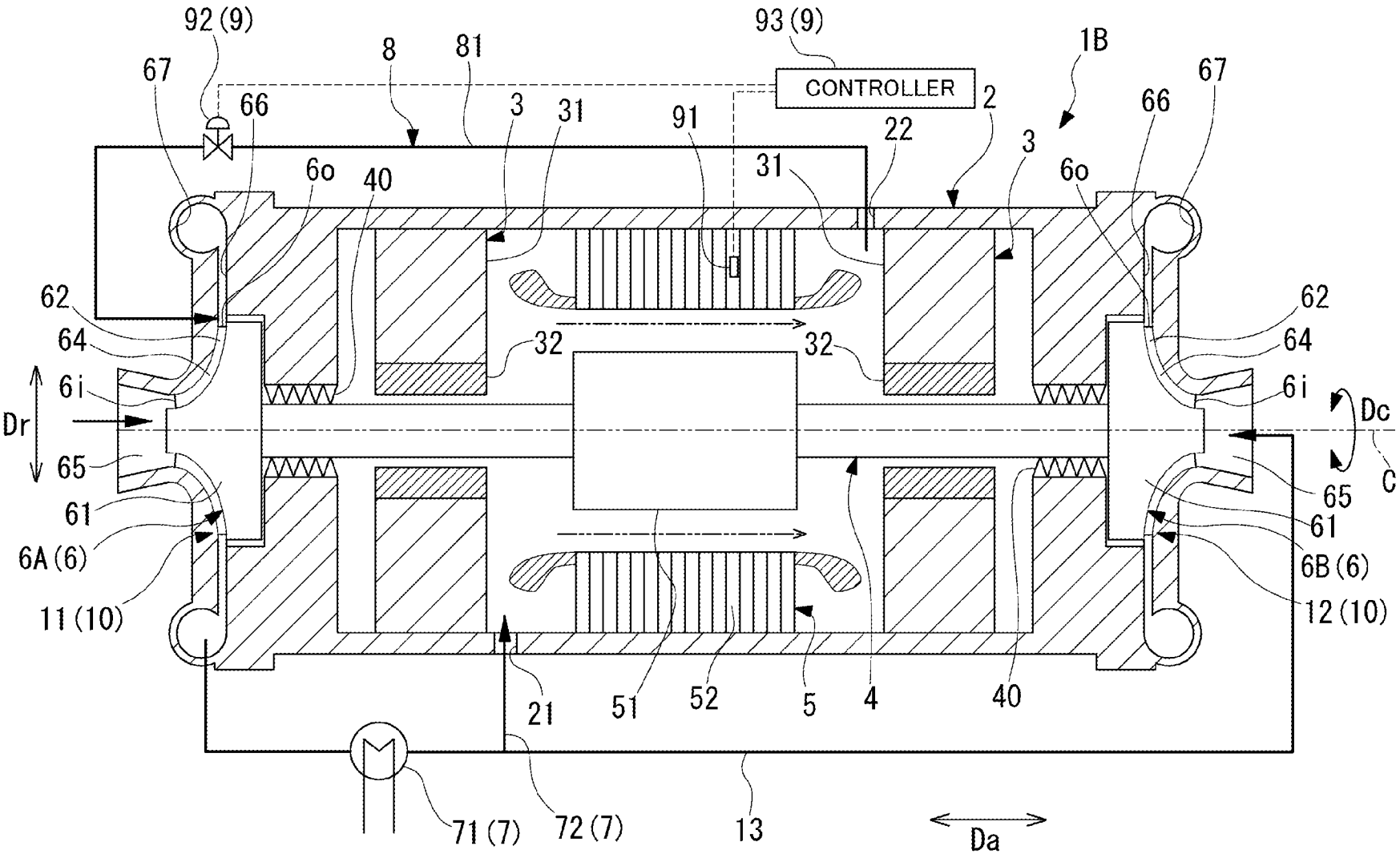
FIG. 2 is a schematic diagram showing a schematic configuration of a compressor according to a second embodiment of the present invention.

FIG. 2 is a schematic diagram showing a schematic configuration of the compressor according to the second embodiment of the present invention. FIG. 3 is a flowchart showing a flow for controlling supply of cooling fluid in the compressor. As shown in FIG. 2, the compressor 1B of the second embodiment is a motor-integrated compressor including a plurality of impellers 6 as in the first embodiment. The compressor 1B further includes a detecting unit 91 and a flow rate adjusting unit 9.

The detecting unit 91 detects a parameter that varies in correlation with a temperature change of the motor 5. In the present embodiment, the detecting unit 91 detects the temperature of the coil of the stator 52 in the casing 2 as a parameter.

The flow rate adjusting unit 9 adjusts the flow rate of the cooling fluid supplied into the casing 2 based on the detection result in the detecting unit 91. The flow rate adjusting unit 9 includes a control valve 92 and a controller 93.

The control valve 92 is provided in a discharge pipe 81, for example. The control valve 92 adjusts the opening degree, thereby adjusting the flow rate of the cooling fluid flowing through the discharge pipe 81, that is, the flow rate of the cooling fluid supplied to the inlet of the diffuser 66. The control valve 92 adjusts the flow rate of the cooling fluid supplied to the inlet of the diffuser 66, and as a result, adjusts the flow rate of the cooling fluid supplied into the casing 2. The control valve 92 may be provided in the supply pipe 72.

The controller 93 adjusts the opening degree of the control valve 92 based on the detection result in the detecting unit 91. The controller 93 increases the opening degree of the control valve 92 when the detection result in the detecting unit 91 exceeds a predetermined first reference value. As a result, the flow rate of the cooling fluid supplied to the inlet of the diffuser 66 increases. The controller 93 reduces the opening degree of the control valve 92 when the detection result in the detecting unit 91 is less than a predetermined second reference value. As a result, the flow rate of the cooling fluid supplied to the inlet of the diffuser 66 is reduced. In the present embodiment, the controller 93 adjusts the opening degree of the control valve 92 in, for example, two stages of "fully open" and "fully closed". Of course, the controller 93 may adjust the opening degree of the control valve 92 in three or more stages.

Figure 3:
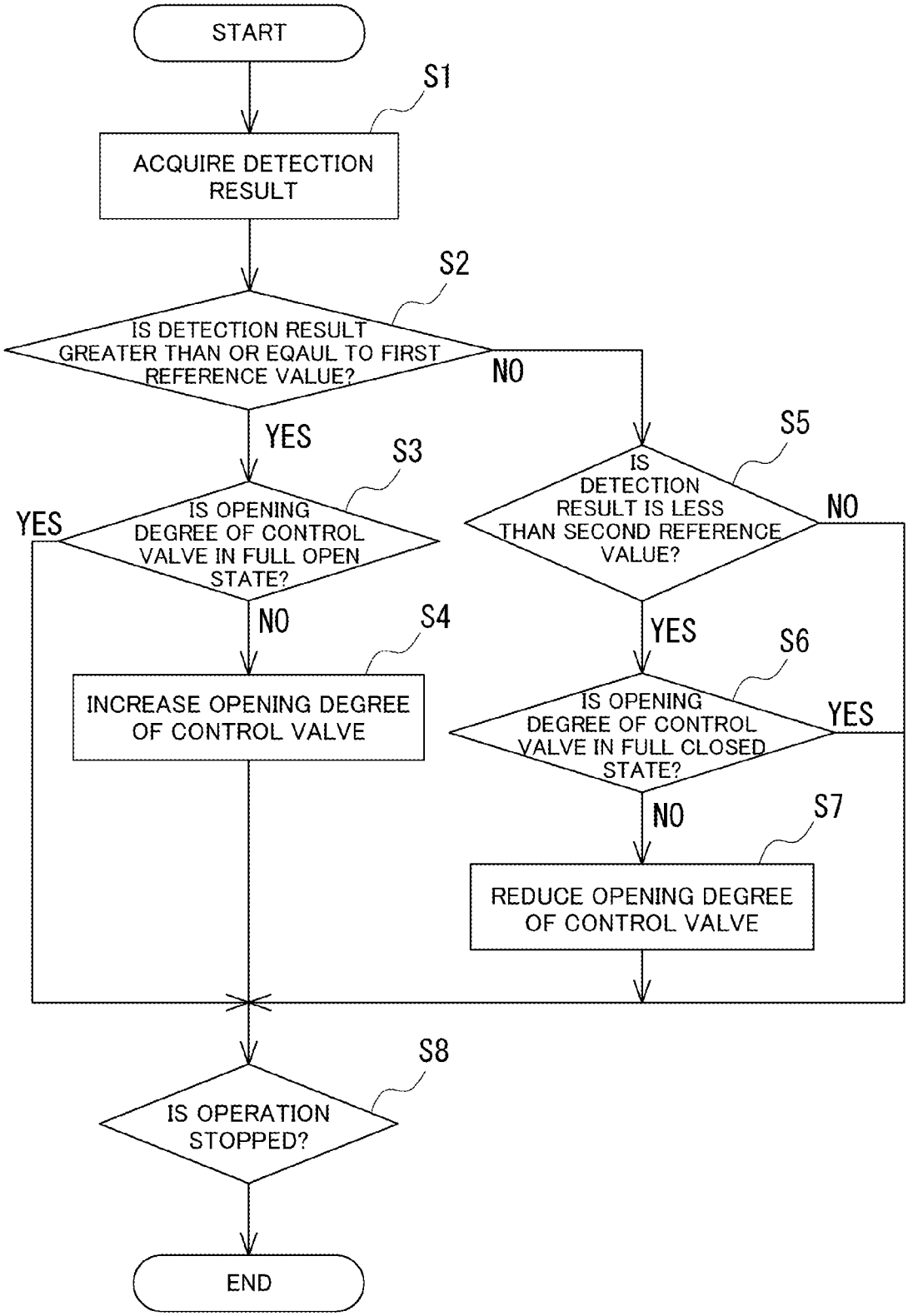
FIG. 3 is a flowchart showing a flow for controlling supply of cooling fluid in the compressor.

As shown in FIG. 3, the controller 93 acquires the detection result in the detecting unit 91 every predetermined time during the operation of the compressor 1B (step S1). In the present embodiment, the controller 93 acquires the detection result of the temperature of the coil of the stator 52 from the detecting unit 91.

The controller 93 determines whether or not the detection result in the detecting unit 91 is greater than or equal to a predetermined first reference value (step S2).

When the detection result in the detecting unit 91 is equal to or greater than the predetermined first reference value, the controller 93 further determines whether or not the opening degree of the control valve 92 at that time is in the "fully open" state. (Step S3).

In step S3, when the opening degree of the control valve 92 is in the "fully open" state, since the controller 93 cannot further increase the opening degree of the control valve 92, the process proceeds to step S8 to be described later.

In step S3, when the opening degree of the control valve 92 is not in the "fully open" state, the controller 93 increases the opening degree of the control valve 92 to "fully open" (step S4). In this way, when the temperature of the motor 5 is higher than the first reference value, the flow rate of the cooling fluid supplied into the casing 2 is increased, and the degree of cooling of the motor 5 is increased.

In step S2, when the detection result in the detecting unit 91 is less than the predetermined first reference value, the controller 93 determines whether or not the detection result in the detecting unit 91 is equal to or less than the predetermined second reference value (Step S5). The second reference value is less than the first reference value (second reference value<first reference value).

When the detection result in the detecting unit 91 is less than the predetermined second reference value, the controller 93 further determines whether or not the opening degree of the control valve 92 at that time is in the "fully closed" state. (Step S6).

In step S6, when the opening degree of the control valve 92 is in the "fully closed" state, since the controller 93 cannot further reduce the opening degree of the control valve 92, the process proceeds to step S8.

In step S6, when the opening degree of the control valve 92 is not in the "fully closed" state, that is, when the control valve 92 is open, the controller 93 reduces the opening degree of the control valve 92 to "fully closed" (Step S7). In this way, when the temperature of the motor 5 is less than the second reference value and the temperature is sufficiently low, the flow rate of the cooling fluid supplied into the casing 2 is reduced, and the cooling degree of the motor 5 is weakened (cooling is stopped).

Then, the controller 93 determines whether or not the operation of the compressor 1 is stopped (step S8). As a result, when the operation of the compressor 1B has is stopped, the controller 93 ends the series of processes. On the other hand, until the operation of the compressor 1B is stopped, the controller 93 returns to step S1 and repeats the series of processes at regular intervals.

With the compressor 1B as described above, the cooling fluid is supplied by the cooling fluid supplying unit 7 as in the first embodiment. Accordingly, it is possible to suppress loss while cooling the motor 5 in the compressor 1 and increase the efficiency of the compressor.

Further, with the compressor 1B, it is possible to adjust the flow rate of the cooling fluid based on the temperature of the stator 52, and to adjust the degree of cooling of the motor 5 by the cooling fluid. When a magnet of the motor 5 is provided in the motor rotor 51, it is difficult to directly detect the temperature of the magnet that rotates integrally with the motor rotor 51. However, by detecting the temperature of the coil of the stator 52, the temperature of the motor 5 (the temperature of the magnet) can be estimated, and the flow rate of the cooling fluid can be adjusted appropriately.

Further, the flow rate adjusting unit 9 increases the flow rate of the cooling fluid when the temperature of the motor 5 rises. In this way, when the rotation speed and output of the motor 5 increase and the temperature of the motor 5 rises, it is possible to appropriately cool the magnet. Further, the flow rate adjusting unit 9 decreases the flow rate of the cooling fluid supplied into the casing 2 when the temperature of the motor 5 decreases. In this way, when the rotation speed and output of the motor 5 are lowered and the temperature of the motor 5 is lowered, it is possible to minimize the circulating amount of the cooling fluid fed into the casing 2. As a result, it is possible to suppress unnecessary reduction in efficiency of the compressor 1.

In the above embodiment, the temperature of the coil of the motor 5 is detected by the detecting unit 91. However, the present invention is not limited thereto. The detecting unit 91 only needs to detect a parameter that varies in correlation with a temperature change of the motor 5. The parameter may be, for example, the rotational speed or power of the motor 5.

Third Embodiment

Next, a third embodiment of the compressor of the present invention will be described with reference to FIG. 4 and FIG. 5. The compressor shown in the third embodiment is different from the first and second embodiments in that it includes a chamber and a plurality of nozzles. Therefore, in the description of the third embodiment, the same portions as those in the first and second embodiments are denoted by the same reference numerals and repeated descriptions thereof will be omitted.

Figure 4:
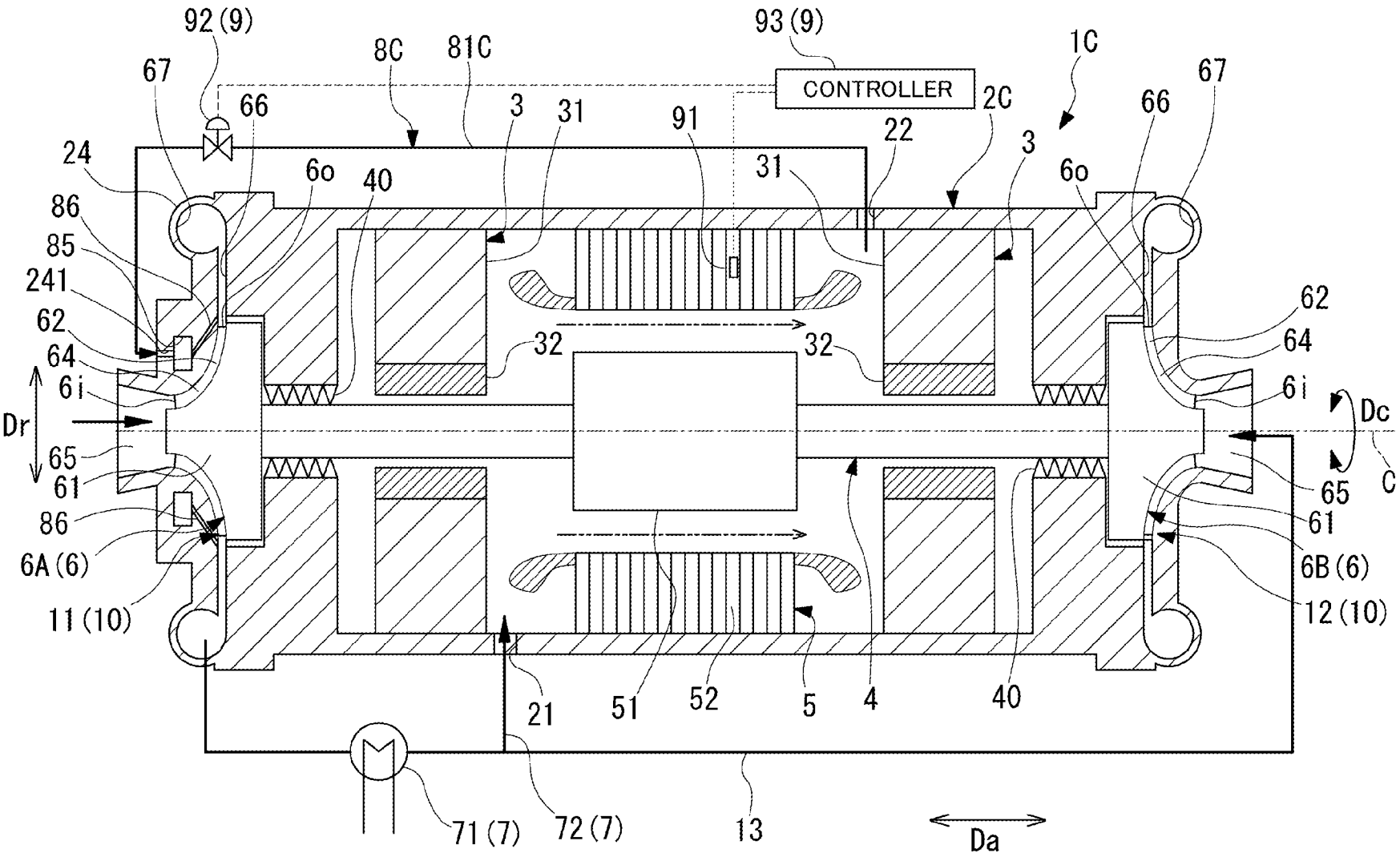
FIG. 4 is a schematic diagram showing a schematic configuration of a compressor according to a third embodiment of the present invention.
Figure 5:
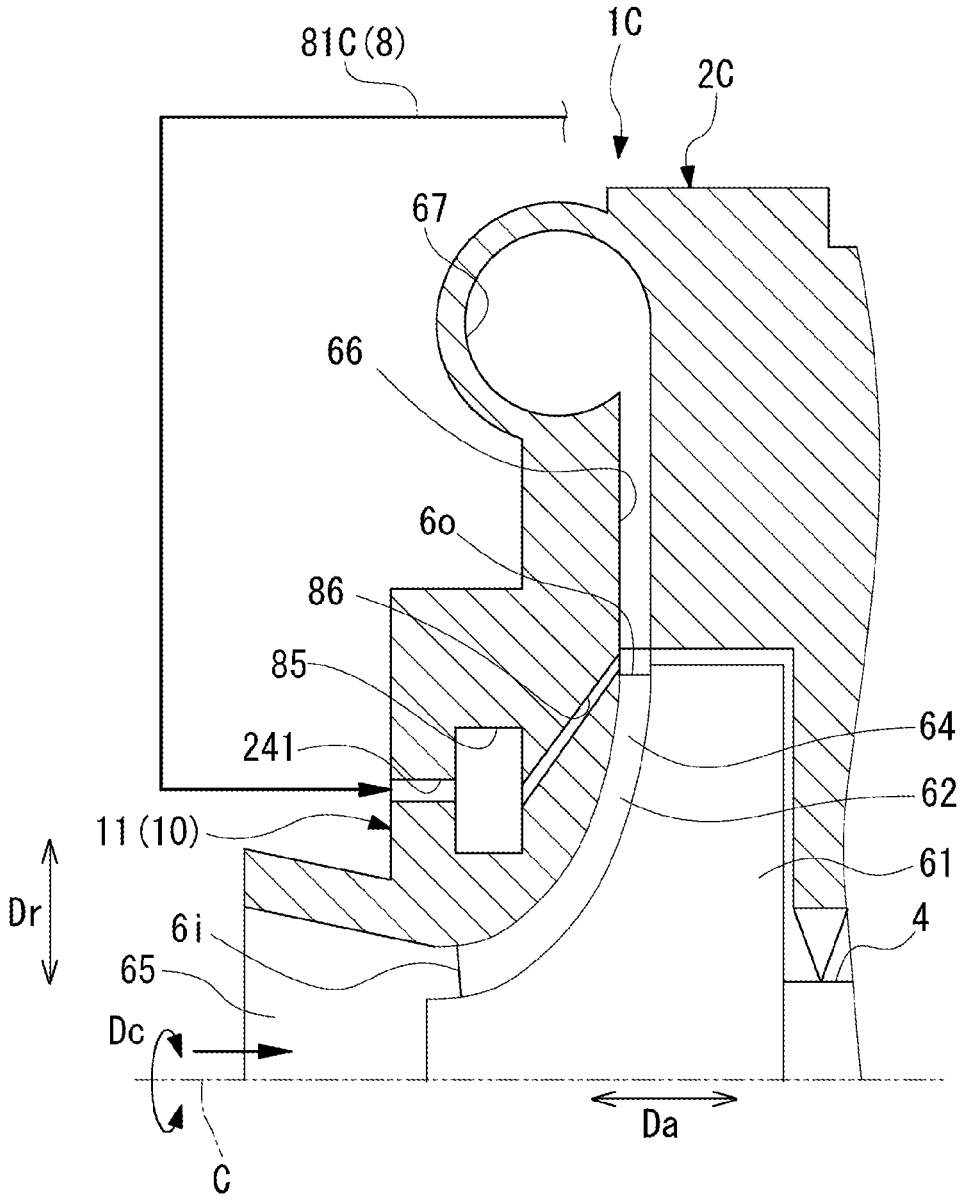
FIG. 5 is an enlarged sectional view showing a chamber and a nozzle provided in the compressor.

FIG. 4 is a schematic diagram showing a schematic configuration of the compressor according to the third embodiment of the present invention. FIG. 5 is an enlarged sectional view showing a chamber and a nozzle provided in the compressor.

As shown in FIG. 4, the compressor 1C according to the third embodiment includes a casing 2, a bearing 3, a rotating shaft 4, a motor 5, an impeller 6, a cooling fluid supplying unit 7, a cooling fluid circulating unit 8C, a chamber 85, and a plurality of nozzles 86.

The chamber 85 and the plurality of nozzles 86 are formed in the casing 2C. The chamber 85 is a space formed in the casing 2C. The chamber 85 extends in the circumferential direction Dc so as to form an annular shape around the rotating shaft 4 when viewed in the axial direction Da. The chamber 85 communicates with the outside of the casing 2C through a connection port 241. The connection port 241 is connected to the other end of the discharge pipe 81C (the end that is not connected to the outlet-side connection opening 22).

The plurality of nozzles 86 are provided at equal intervals in the circumferential direction Dc. One end of each nozzle 86 communicates with the chamber 85. The other end of each nozzle 86 communicates with the diffuser 66. Each nozzle 86 extends with an inclination toward the outside in the radial direction Dr as it approaches the diffuser 66 from the chamber 85 in the axial direction Da. Each nozzle 86 is provided to be inclined in a direction along the flow of the working fluid in the diffuser 66 with respect to the axial direction Da. That is, each nozzle 86 is inclined from the upstream to the downstream in the flow direction of the working fluid in the diffuser 66 as it approaches the diffuser 66 from the chamber 85.

The cooling fluid, which has flowed into the discharge pipe 81C from the outlet-side connection opening 22, flows into the chamber 85 through the connection port 241. The cooling fluid that has flowed into the chamber 85 spreads in the entire circumferential direction in the chamber 85 and then flows into each nozzle 86. The cooling fluid is fed into the diffuser 66 through each nozzle 86. In this way, the cooling fluid circulating unit 8C supplies the cooling fluid discharged to the outside of the casing 2 downstream of the outlet 6*o* of the first impeller 6A and upstream of the diffuser 66.

With the compressor 1C as described above, the cooling fluid is supplied by the cooling fluid supplying unit 7 as in the first and second embodiments, thereby making it possible to cool the motor 5 in the casing 2. Therefore, since the cooling fluid passing through the motor 5 is returned to the inlet of the diffuser 66, it is not necessary to pressurize the cooling fluid again with the first impeller 6A, and it is possible to suppress the occurrence of loss. As a result, it is possible to suppress loss in the compressor 1 and improve the efficiency of the compressor 1 while cooling the motor 5 of the compressor 1.

Further, with the compressor 1C as described above, the cooling fluid is sent to the diffuser 66 through the plurality of nozzles 86. Therefore, in the diffuser 66, the bias of the returned cooling fluid is suppressed depending on the position in the circumferential direction Dc. As a result, it is possible to make the pressure distribution in the circumferential direction Dc of the working fluid flowing through the diffuser 66 uniform.

Further, the cooling fluid circulating unit 8 supplies the cooling fluid discharged to the outside of the casing 2 to the plurality of nozzles 86 through the chamber 85. Before being supplied to the plurality of nozzles 86, the pressure distribution of the cooling fluid is once uniformized in the chamber 85. Then, the cooling fluid is fed from the chamber 85 to each nozzle 86. In this way, it is possible to make the flow rate of the cooling fluid fed to each nozzle 86 uniform. Therefore, it is possible make the pressure distribution in the circumferential direction Dc of the working fluid flowing through the diffuser 66 more uniform.

The nozzle 86 is provided to be inclined in a direction along the flow of the working fluid. With such a configuration, it is possible to suppress interference between the cooling fluid sent out from the nozzle 86 and the flow of the working fluid in the diffuser 66 discharged from the first impeller 6A outward in the radial direction Dr. As a result, it is possible to suppress loss.

It is preferable that the number of nozzles 86 provided is not a divisor or multiple of the blade portion 62 of the first impeller 6A. In this way, it is possible to suppress resonance between the cooling fluid discharged from the nozzle 86 and the first impeller 6A.

Other Modification of Embodiment

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

In addition, the configuration regarding the impeller 6 is not limited to the configuration in which two impellers are disposed, as in the compressors 1, 1B, and 1C of the embodiments. For example, one impeller 6 may be provided, or a plurality of impellers 6 having three or more stages may be provided as in a multistage centrifugal compressor. Moreover, the impeller 6 is not limited to an open impeller like the embodiments as described above. The impeller 6 may be a closed impeller having a cover. Different types of impellers may be applied to the first compression section 11 and the second compression section 12.

Moreover, in each of the embodiments described above, although the heat exchanger 71 is provided in the pressurization gas line 13, the heat exchanger 71 is not limited to such a disposition. The heat exchanger 71 only needs to be able to cool at least some of the working fluid compressed by the impeller 6. Therefore, the heat exchanger 71 may be provided in the supply pipe 72, for example. In this case, only some of the working fluid compressed by the first impeller 6A is cooled by the heat exchanger 71, and the rest is supplied as it is to the second compression section 12 through the pressurization gas line 13. Furthermore, the heat exchanger 71 may be provided in the discharge pipe 81.

Moreover, in the second embodiment, although the control valve 92 is provided in the discharge pipe 81, the control valve 92 is not limited to such a disposition. The control valve 92 only needs to be provided at a position where the flow rate of the cooling fluid supplied into the casing 2 can be adjusted. Therefore, the control valve 92 may be provided in the pressurization gas line 13 or the supply pipe 72.

Moreover, in each of the embodiment described above, although the motor 5 was illustrated as a cooling object part of the cooling fluid supplied into the casing 2, the cooling object part is not limited to the motor 5. As a cooling target part disposed in the casing 2, the bearing 3 which rotatably supports the rotating shaft 4 may be a cooling target part, for example. Furthermore, the bearing 3 is not limited to a gas bearing, but may be another type such as a magnetic bearing. In addition, when the cooling object part is the bearing 3, the configuration in which the motor 5 is built in the casing 2 is not essential. That is, the compressor may be provided separately from the casing 2 and may be rotationally driven by the motor, or may allow the rotational shaft may to be rotationally driven by a drive source other than the motor.

EXPLANATION OF REFERENCES

1, 1B, 1C: compressor
2, 2C: casing
3: bearing
4: rotating shaft
5: motor
6: impeller
6A: first impeller
6B: second impeller
6*i*: inlet
6*o*: outlet
7: cooling fluid supplying unit
8, 8C: Cooling fluid circulating unit
9: flow rate adjusting unit
10: compression section
11: first compression section
12: second compression section
13 pressurization gas line
21: inlet-side connection opening
22: outlet-side connection opening
31: bearing housing
32: pad
40: sealing portion
51: motor rotor
52: stator
61: disk portion
62: blade portion
64: impeller channel
66: diffuser
67: exhaust passage
71: heat exchanger
72: supply pipe
81, 81C: discharge pipe
85: chamber
86: nozzle
91: detecting unit (detector)
92: control valve
93: controller
241: connection port
C: axis
Da: axial direction
Dc: circumferential direction
Dr: radial direction

What is claimed is:

1. A compressor comprising:

a rotating shaft that rotates around an axis;

an impeller that rotates along with the rotating shaft to compress and discharge an intake working fluid;

a casing that covers the rotating shaft and the impeller and comprises a diffuser for guiding the working fluid discharged from the impeller to an outside in a radial direction of the rotating shaft;

a cooling fluid supplying unit that supplies the working fluid compressed by the impeller into the casing as a cooling fluid for cooling a cooling object part disposed in the casing; and a cooling fluid circulating unit that discharges the cooling fluid that has passed through the cooling object part to an outside of the casing, and supplies the discharged cooling fluid downstream of an outlet of the impeller and upstream of the diffuser, wherein the cooling fluid supplying unit comprises:

a heat exchanger that cools at least a portion of the working fluid; and a supply pipe that supplies some of the working fluid after being cooled by the heat exchanger to an inside of the casing, wherein the casing has a plurality of nozzles that are connected to the diffuser and are disposed at intervals in a circumferential direction around the axis of the rotating shaft, and wherein the cooling fluid circulating unit supplies the cooling fluid discharged to the outside of the casing to the diffuser through the plurality of nozzles.

2. The compressor according to claim 1, wherein each of the plurality of nozzles is inclined with respect to an axial direction in which the axis extends, and wherein each of the plurality of nozzles extends so as to incline from an upstream to a downstream in a flow direction of the working fluid in the diffuser.

3. The compressor according to claim 1, further comprising:

a chamber that extends in the circumferential direction and contacts each of the plurality of nozzles, wherein the cooling fluid circulating unit supplies the cooling fluid discharged to the outside of the casing to each of the plurality of nozzles through the chamber.

4. The compressor according to claim 1, further comprising:

a motor that is disposed in the casing and drives the rotating shaft to rotate around the axis, wherein the cooling fluid supplied into the casing by the cooling fluid supplying unit cools the motor, wherein the motor is the cooling object part.

* * * * *